US005125663A

United States Patent [19]

Lurowist, Jr.

[11] Patent Number: 5,125,663

[45] Date of Patent: Jun. 30, 1992

[54] GOLF SWING TRAINING APPARATUS

[76] Inventor: Nicholas Lurowist, Jr., 97 Concord St., Wayland, Mass. 01778

[21] Appl. No.: 665,541

[22] Filed: Mar. 6, 1991

[51] Int. Cl.[5] ..... A63B 69/36

[52] U.S. Cl. ..... 273/183 B; 273/188 R; 482/148

[58] Field of Search ..... 272/73; 273/188 R, 188 A, 273/190 R, 190 A, 190 B, 183 B

[56] References Cited

U.S. PATENT DOCUMENTS 1,872,256 8/1932 Denney ..... 272/73
3,138,388 6/1964 Herold ..... 273/183 B
4,871,164 10/1989 Tseng ..... 272/73
5,050,885 9/1991 Ballard et al. ..... 273/188 R X

*Primary Examiner*—George J. Marlo
*Attorney, Agent, or Firm*—John E. Toupal; Harold G. Jarcho

[57] ABSTRACT

A golf swing training apparatus including a base; a strut having one end supported by the base; a support retained by a portion of the strut opposite to the one end, the support adapted to project between a golfer's legs and to engage the groin regions thereof; and a rotational coupling allowing rotation of the support means in response to rotational movement of the golfer's hips. This structural combination desirably provides a steady base, allows the hips to pivot around a near vertical axis and keeps the groin area fixed in space.

24 Claims, 8 Drawing Sheets

GOLF SWING TRAINING APPARATUS

BACKGROUND OF THE INVENTION

This invention relates generally to a golf swing training apparatus and, more particularly, to an apparatus which can be used repeatedly by a user to develop a functional golf swing.

Many training devices have been proposed for improving the golf swing. Most such devices are intended for repeated use to introduce "muscle memory" that will lead to a proper swing without the aid of the device. The devices include, for example, coded mats which show you how to place your feet and the recommended path of the club as it approaches the ball; a golf club which is half rope to teach "rhythm"; golf clubs with bent shafts to train the forearms to rotate properly; weighted clubs to develop strength; clubs which click to indicate a proper timing and "release"; devices which click when you shift your weight improperly; attachments for golf club and the wall which force the club to trace a proper plane; a stationary helmet which keeps the head in a fixed position; inclined planes or tracks to guide a club; etc. However, all of these prior devices can be used improperly and can lead to frustration, lack of confidence, and ultimate abandonment.

The object of this invention is to provide an apparatus which controls the angle of the spine and the rotary and lateral motion of the hips and groin area rather than restricting or influencing the perimeter area of the body as prior devices have done.

SUMMARY OF THE INVENTION

The invention encompassed in one embodiment is a golf swing training apparatus including a base; a strut having one end supported by the base; a support retained by a portion of the strut opposite to the one end, the support adapted to project between a golfer's legs and to engage the groin regions thereof; and a rotational coupling allowing rotation of the support means in response to rotational movement of the golfer's hips. This structural combination desirably provides a steady base. allows the hips to pivot around a near vertical axis and keeps the groin area fixed in space.

The invention further encompasses in another embodiment a golf swing training apparatus including a strut having one end adapted for support by a support surface; a support retained by a portion of the strut opposite to the one end, the support adapted to project between a golfer's legs and to engage the groin regions thereof; a rotational coupling allowing rotation of the support in response to rotational movement of the golfer's hips; and a translational coupling adapted during rotation of the support to allow reciprocating movement thereof in directions substantially transverse to the strut. The translational coupling desirably allows a slight forward movement of the golfer's body during a forward swing.

The invention additionally encompasses in another embodiment a golf swing training apparatus including a strut having one end adapted for support by a support surface; a support retained by a portion of the strut opposite to the one end, the support adapted to project between a golfer's legs and to engage the groin regions thereof; a rotational coupling allowing rotation of the support in response to rotational movement of the golfer's hips; and a restraint supported by the strut and extending upwardly from the support, the restraint adapted to engage and substantially restrain the golfer's spine in a given orientation during rotation of the support. The restraint desirably prevents lifting of the upper body during a backswing.

According to one feature, the invention includes a release mechanism for automatically deactivating the restraint in response to motion of the support into a predetermined position and to thereby allow movement of the golfer's spine into an orientation different than the given orientation. The release allows the golfer to relax and straighten his body in the later portion of a forward swing.

According to another feature of the invention, the motion of the support is rotation and the predetermined position is a predetermined angular position. Use of support rotation to activate restraint release facilitates desirable operation of the apparatus.

According to another feature, the invention includes a latch latching the restraint in an active position, a means biasing the restraint in that position and a latch adjustment means for selectively adjusting the predetermined position in which the restraint is released. These structural features allow the apparatus to be tailored to a particular golfer.

According to yet another feature, the invention includes a restraint adjustment means for selectively adjusting the height of the restraint relative to the support. The restraint adjustment means facilitates use of the apparatus by golfers of different size.

According to still another feature, the invention includes a support adjustment means for selectively adjusting the height of the support above the base. This feature further adapts the apparatus for use by different golfers.

According to another feature, the invention includes an inclination adjustment means for selectively adjusting the vertical inclination of the strut. The inclination adjustment means allows the apparatus to be tailored to the style of a particular golfer.

According to additional features, the translational coupling permits pivotal movement of the strut to provide reciprocating movement, and includes a stop means for limiting the reciprocating movement of the support means between predetermined first and second pivotal positions thereof, and a stop adjustment means for selectively adjusting the distance between the first and second positions. The stop and stop adjustment permit selection of a selected degree of forward body movement during a forward swing as desired by an individual golfer.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
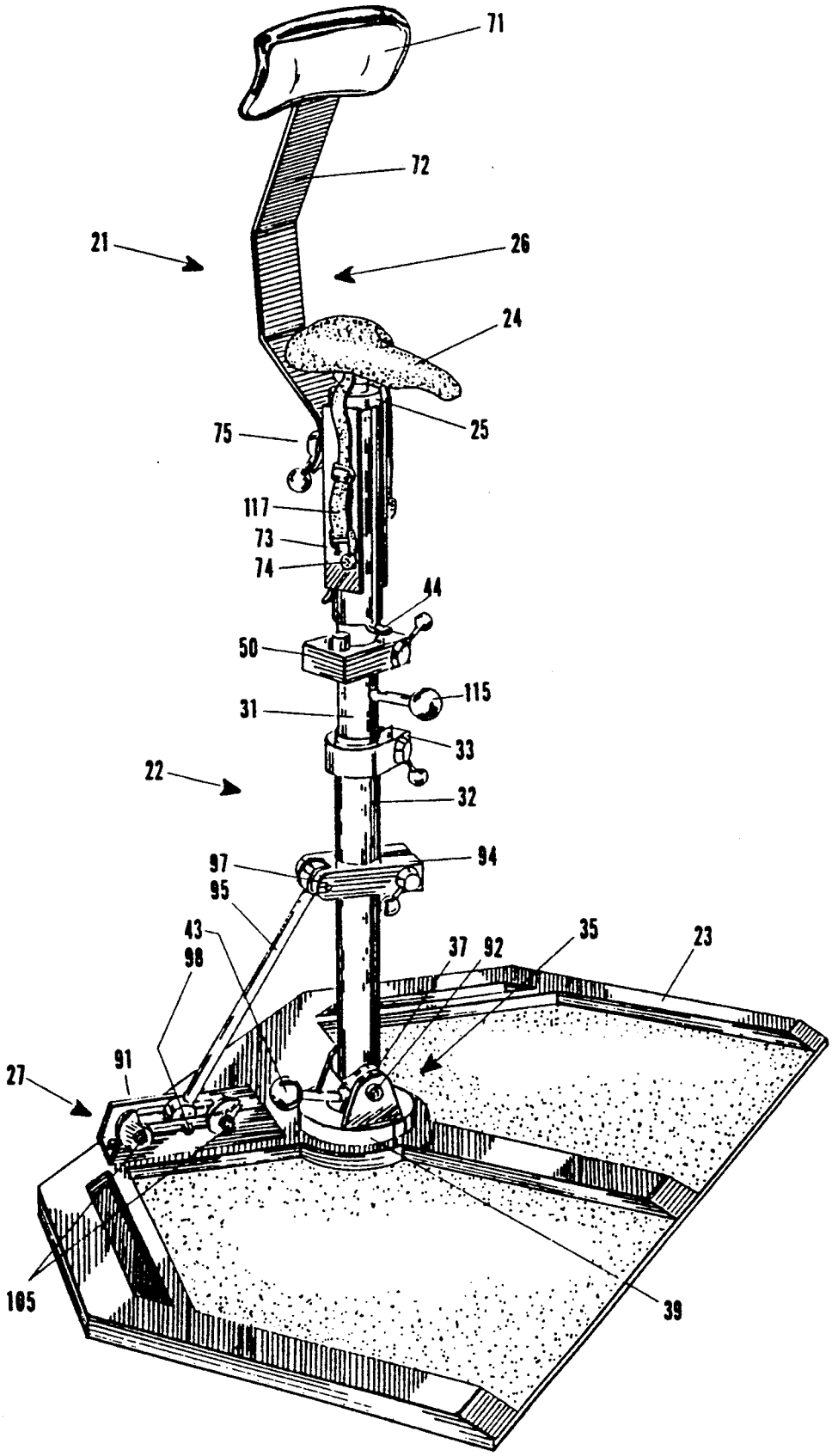
FIG. 1 is a front perspective view of a golf training apparatus according to the invention.
Figure 2:
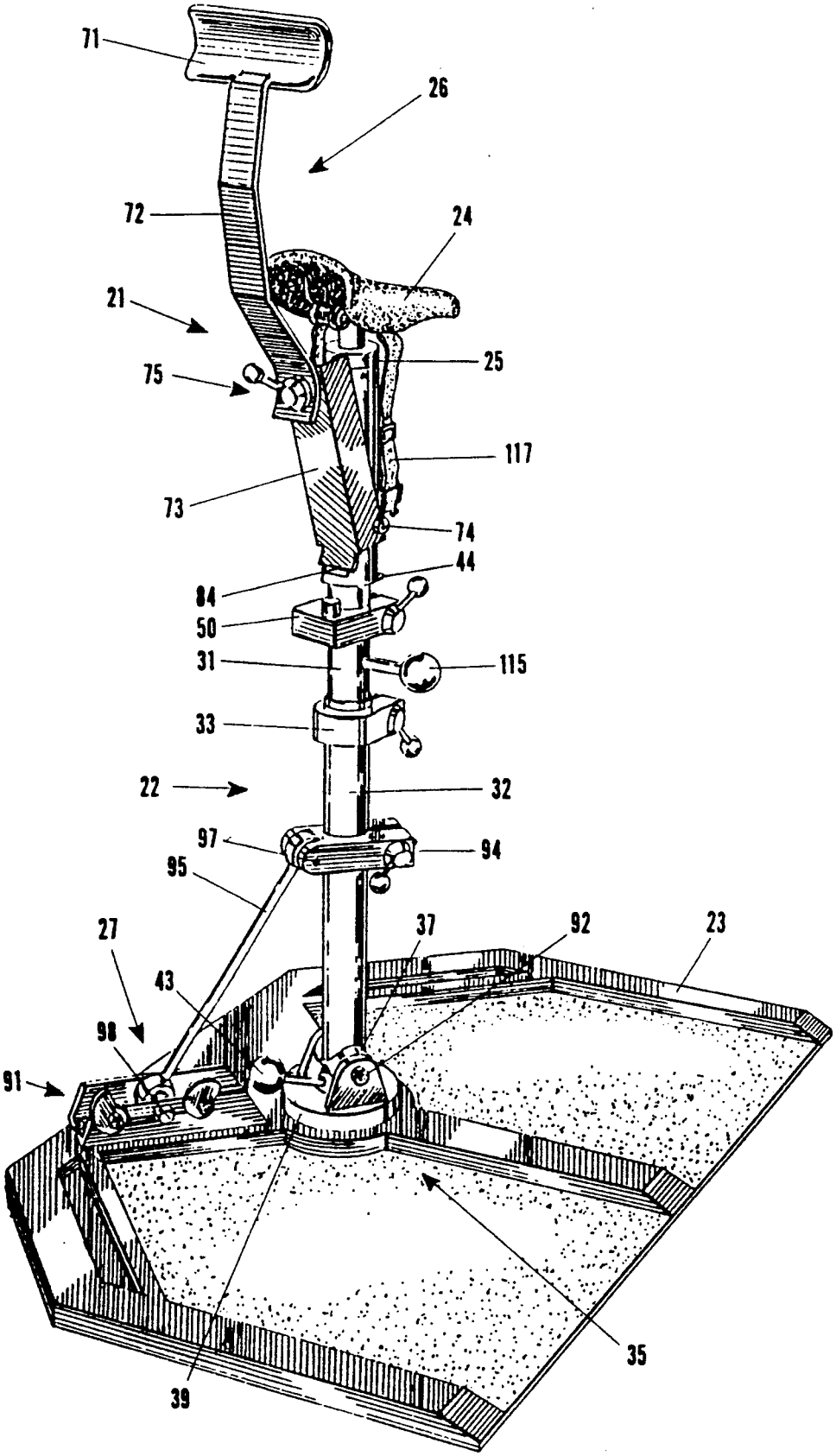
FIG. 2 is a rear perspective view of the apparatus shown in FIG. 1.

A golf swing training apparatus 21 according to the invention is illustrated in FIGS. 1 and 2 The training apparatus 21 includes an elongated strut assembly 22 supported at one end by a base 23, a support seat 24 retained at an opposite end of the strut assembly 22, and a rotational coupling 25 between the strut assembly 22 and the support seat 24 for providing rotational motion thereof. Also included in the apparatus 21 is a spinal restraint 26 supported by the strut assembly 22 above the support seat 24 and a translational coupling mechanism 27 connected between the base 23 and the strut assembly 22.

Figure 3:
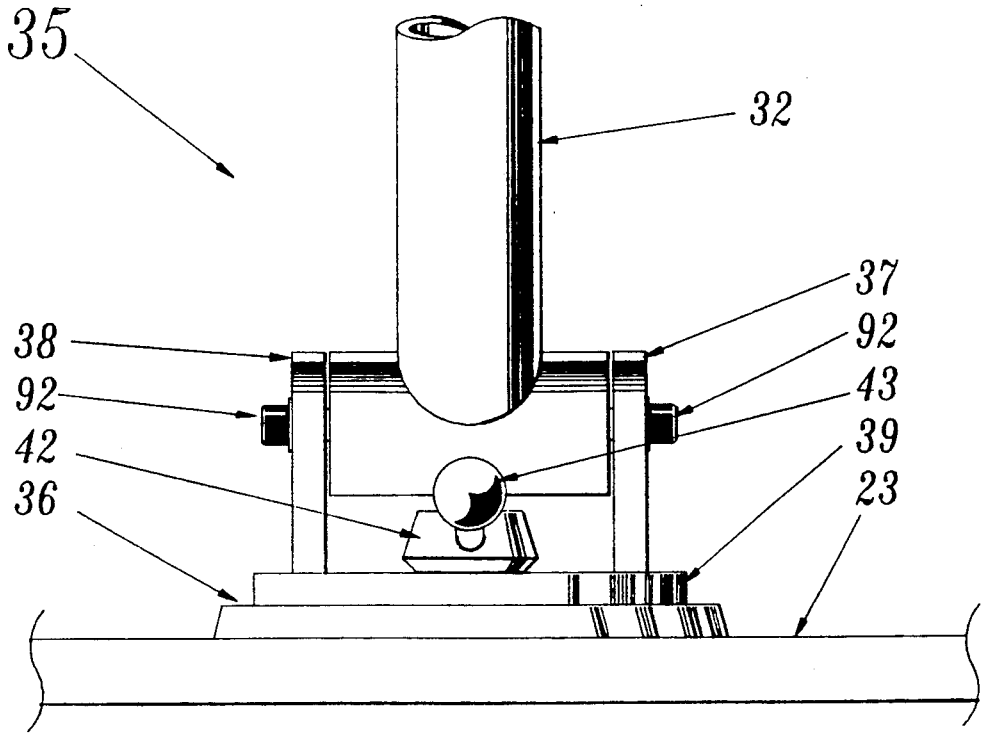
FIG. 3 is a detailed view of a rotational adjustment mechanism employed in the apparatus shown in FIGS. 1 and 2.
Figure 4:
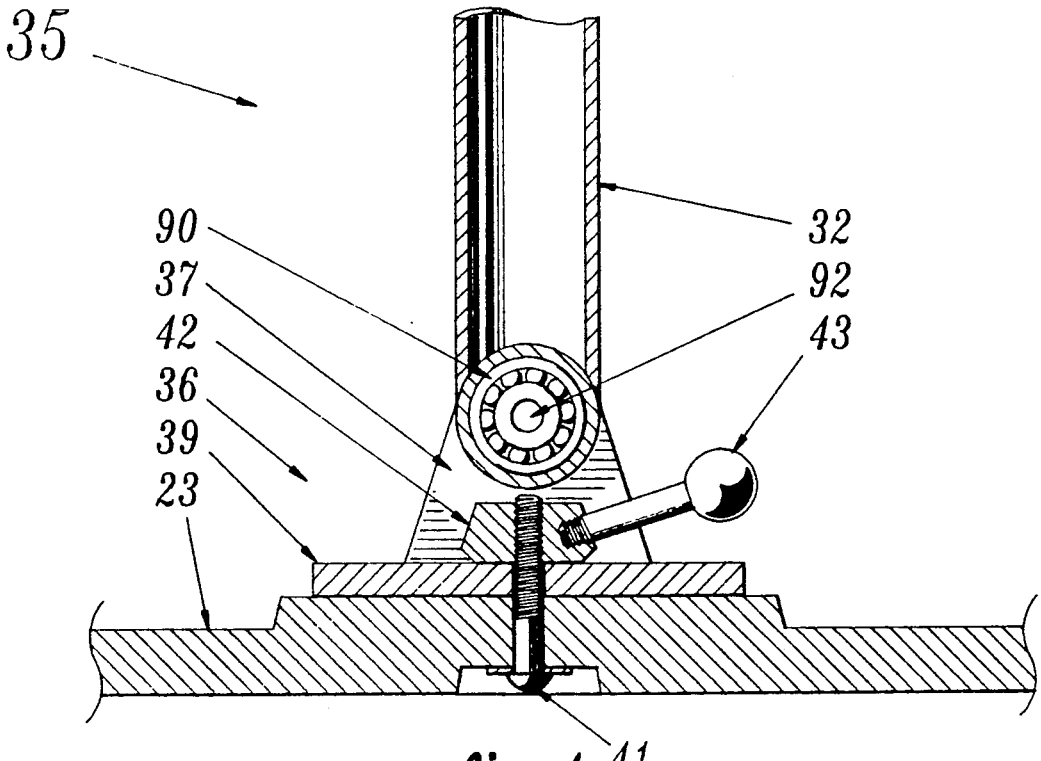
FIG. 4 is a cross-sectional view of the mechanism shown in FIG. 3.
Figure 5:
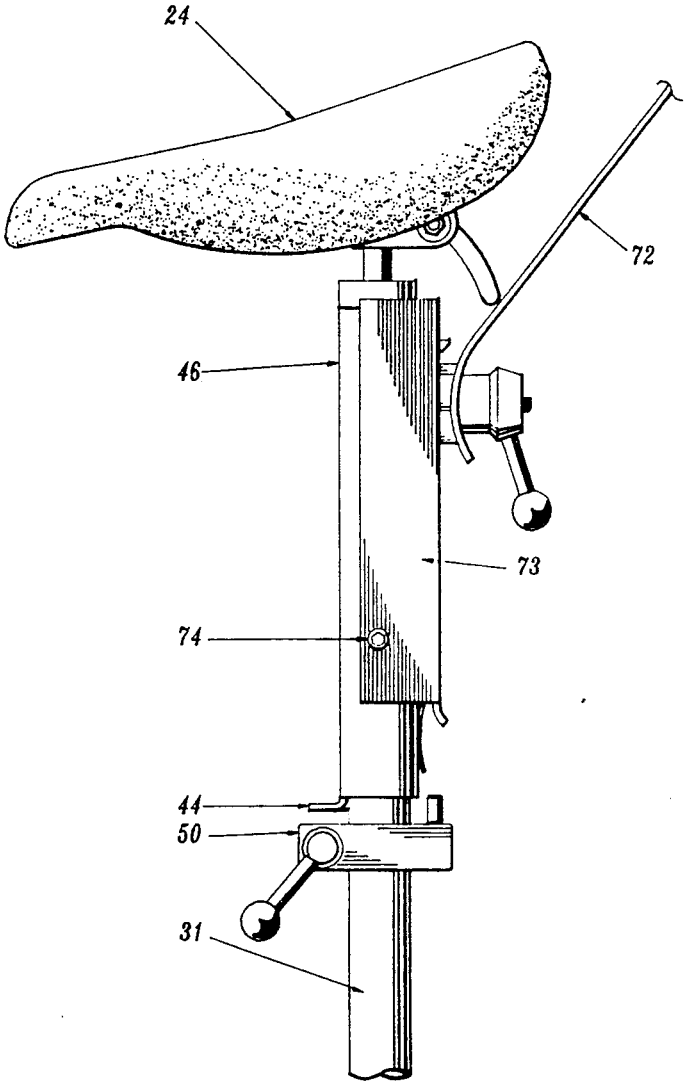
FIG. 5 is a partial view illustrating a release mechanism of the apparatus shown in FIGS. 1 and 2.
Figure 6:
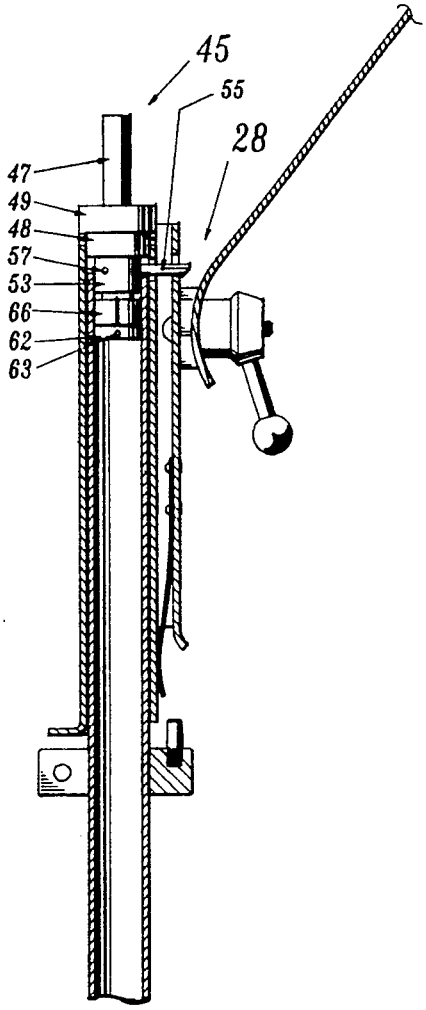
FIGS. 6–8 are cross sectional views of the mechanism shown in FIG. 5.
Figure 7:
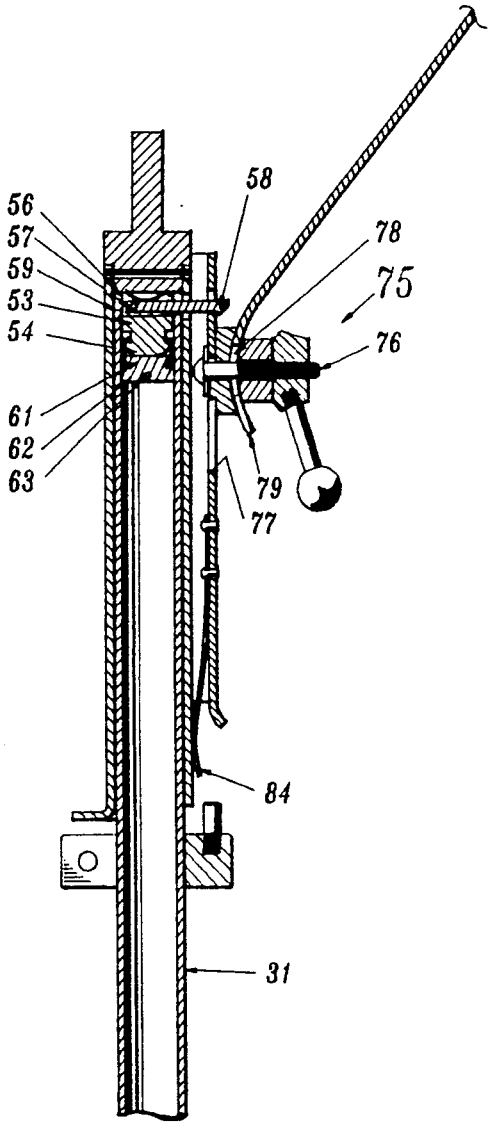

The strut assembly 22 includes an upper tubular member 31 telescopically received by a lower tubular member 32. Positioned at the upper end of the lower tubular member 32 is a releaseable clamp 33 that can be tightened to prevent relative movement between the upper member 31 and the lower member 32 or released to permit either longitudinal or rotational movement of the upper member 31 in the lower member 32. A rotational adjustment mechanism 35 (FIG. 3) attaches a lower end of the lower tubular member 32 to the base 23. Included in the rotational adjustment mechanism 35 is a yoke 36 having spaced apart arms 37, 38 projecting upwardly from a circular plate 39, a bolt 41 extending through the base 23 and the plate 39, and a nut 42 engaging the threaded bolt 41 and having a handle 43. After loosening of the nut 42, the strut assembly 22 can be rotated into a desired angular position relative to the base 23.

The rotational coupling 25 and the release mechanism 28 are shown most clearly in FIGS. 5–8. Forming the rotational coupling 25 is a mounting member 45 and a tubular member 46 that is telescopically received by the outer surface of the upper tubular member 31. The mounting member 45 includes an upper shaft portion 47 and a lower shaft portion 48 straddling an increased diameter mid-portion 49. Receiving an upper end of the tubular member 46 and pinned thereto by a pin 51 is the lower shaft portion 48. The bicycle type support seat 24 is attached to the upper shaft portion 47 in a conventional manner that permits selective tilting. After a predetermined degree of rotational movement by the seat 24 in a forward direction further movement is prevented by engagement between a tab stop 44 on the tubular member 46 and a clamp stop 50 on the tubular member 31.

Figure 8:
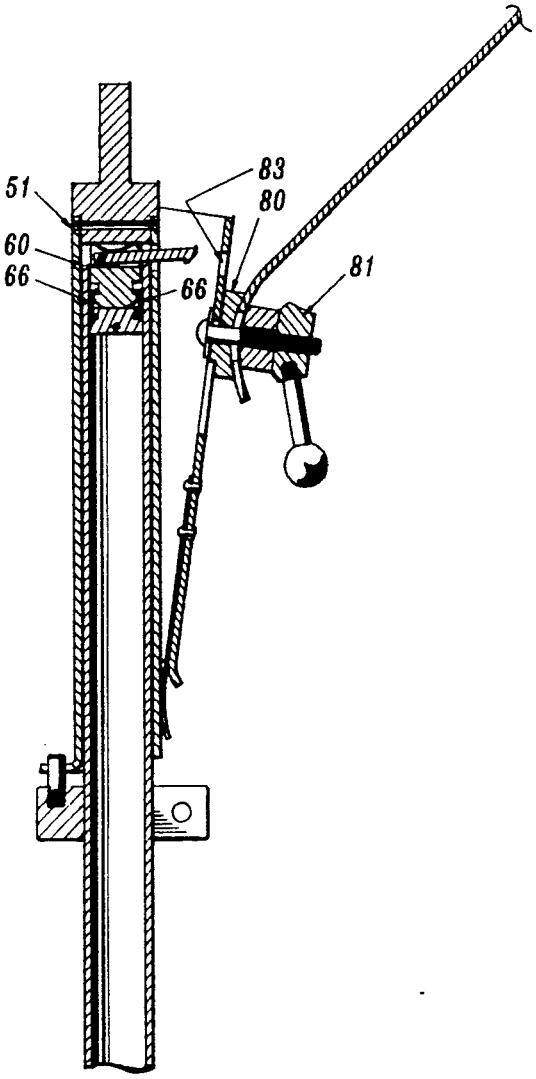
Figure 9:
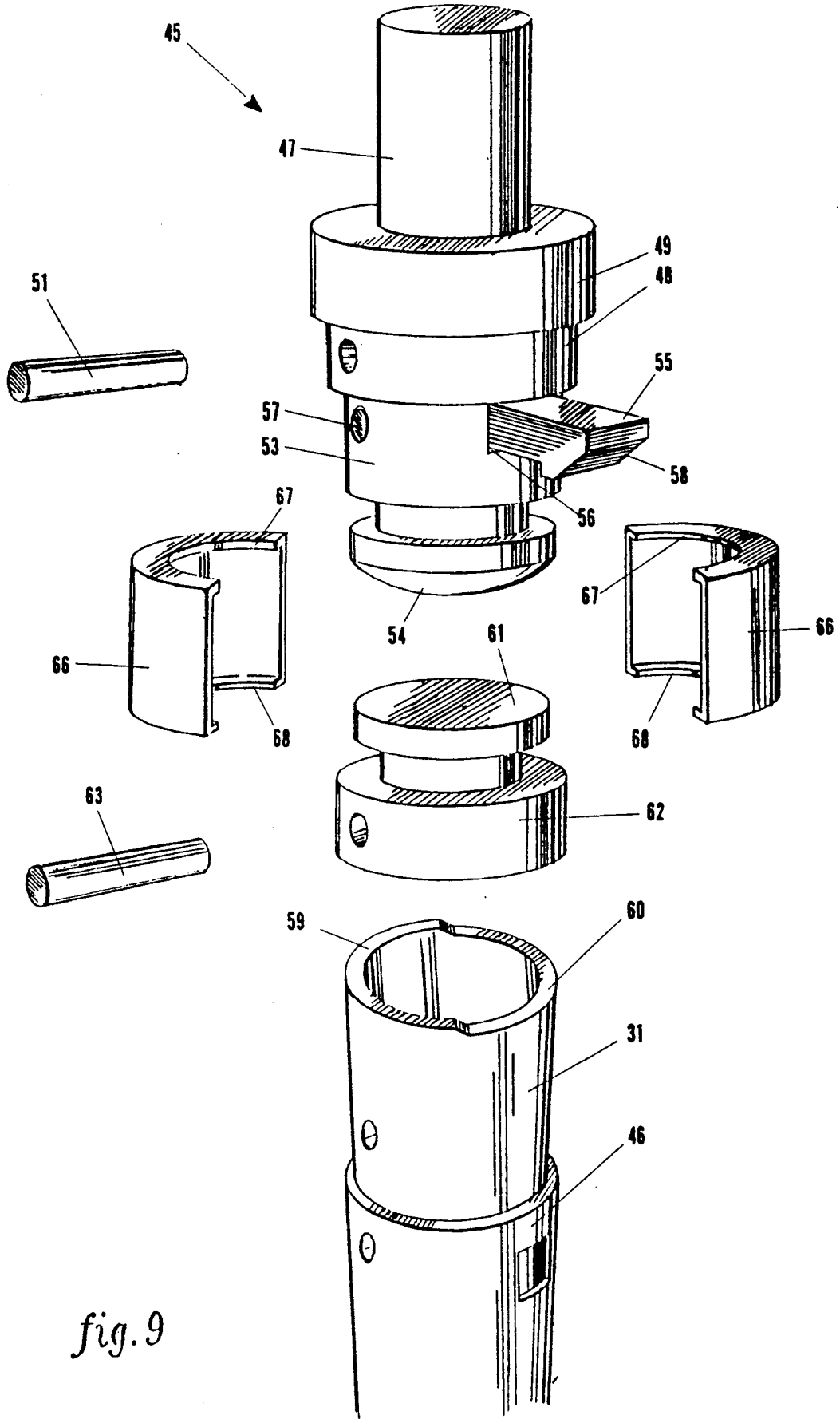
FIG. 9 is an exploded perspective view of a rotational coupling employed with the apparatus shown in FIGS. 1 and 2.
Figure 10:
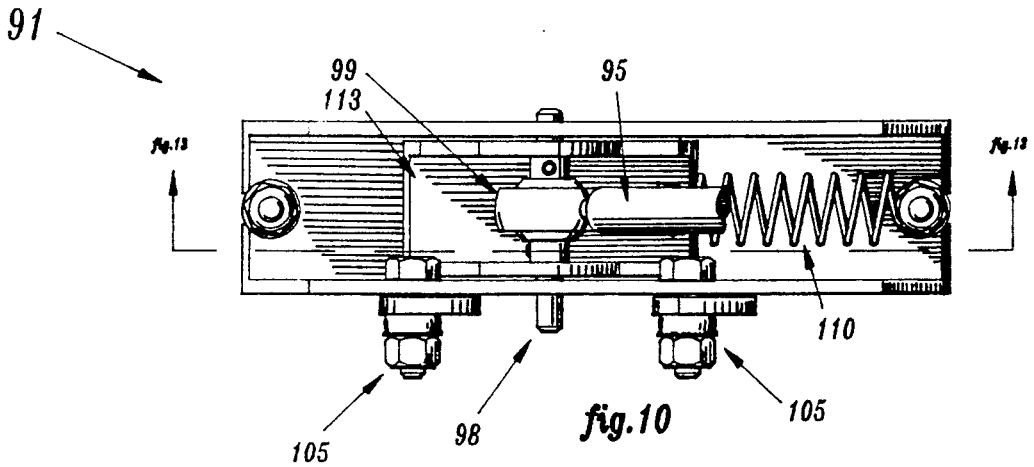
FIG. 10 is a plan view of a translational coupling assembly used with the device shown in FIGS. 1 and 2.
Figure 12:
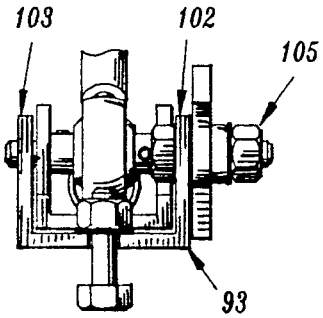
FIG. 12 is a left end view of the coupling assembly shown in FIGS. 10 and 11.
Figure 11:
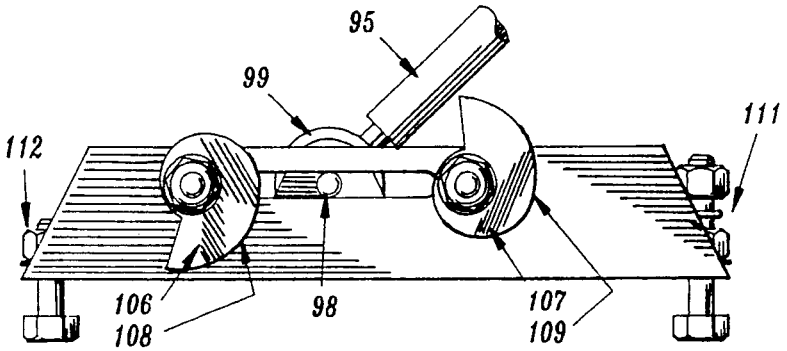
FIG. 11 is a side view of the coupling assembly shown in FIG. 10.
Figure 13:
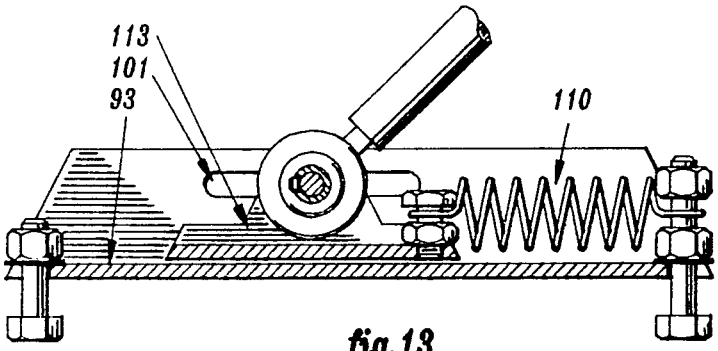
FIG. 13 is a cross sectional view taken along lines 13—13 of FIG. 10.

Included in the release mechanism 28 (FIGS. 5–8) is a projection portion 53 of the mounting member 45. The portion 53 projects downwardly from the lower shaft portion 48 and is terminated by a knob portion 54. A latch arm 55 is received by a slot 56 through the projection portion 53. One end of the latch arm 55 is retained by a pivot pin 57 while an opposite end forms a hook portion 58. An additional portion of the release mechanism 28 is formed by a cam surface 59 (FIG. 9 ) formed on the upper edge of the upper tubular member 31 by a portion more elevated than the remaining portion 60 thereof. In response to simultaneous rotational movement of the support seat 24, the mounting member 45 and the projection portion 53, the cam surface 59 moves into engagement with an intermediate portion of the latch arm 55 so as to produce upward movement of the hook portion 58 as shown in FIG. 8.

Engaged by the knob 54 is a complementary knob 61 on an insert 62 that is received by the upper tubular member 31 and fixed thereto by a pin 63. A pair of arcuate collars 66 have inwardly projecting upper and lower flange portions 67, 68 that engage the knobs 54, 61 so as to prevent relative longitudinal movement between the insert 62 and the mounting member 45 while permitting relative rotational movement therebetween. The outer surfaces of the arcuate sleeves 66 are retained by the inner surface of the upper tubular member 31.

The spine restraint 26 includes a back rest 71 (FIG. 1) attached to one end of an elongated support 72, the opposite end of which is secured to a U-shaped angle iron 73. Pivotally attaching a lower end of the iron 73 to the upper tubular member 31 of the strut assembly 22 is a pivot pin 74 (FIG. 2). The support 72 is retained by a fastener assembly 75 (FIGS. 7 and 8) including a threaded bolt 76 that extends through a vertically extending slot 77 in the iron 73 and a vertically extending slot 78 in a curved lower portion 79 of the support 72. Received by the bolt 76 are a nut 81 and a block 80 disposed between the iron 73 and the curved portion 79 and geometrically conforming thereto. After loosening of the nut 81, the bolt 76 can be adjusted vertically within the slot 77 to establish a desired height for the back rest 71 relative to the support seat 24. Similarly, vertical movement of the curved portion 79 of the support 76 as permitted by the vertical slot 78 permits adjustment in the inclination of the support 72 so as to provide a desired orientation therefor.

Another slot 83 in the angle iron 73 above the fastener assembly 75 receives and engages the hook portion 58 of the latch arm 55 so as to establish a predetermined orientation for the spinal restraint 26. However, in response to upward movement of the latch arm 55 in response to engagement by the cam surface 59, the hook portion 58 is unlatched to release the restraint assembly 26 and allow movement thereof on the pivot pin 74. A bias leaf spring 84 has one end attached by rivets to the angle iron 73 and an opposite end engaged with the tubular member 46. Exerted by the leaf spring 84 is a force that biases the spinal restraint 26 into a position engaged with the hook portion 58 of the latch arm 55.

The translational coupling mechanism 27 (FIGS. 10–13) includes a translational assembly 91 and pin 92 and bearing 90 (FIG. 2) that retain the lower end of the lower tubular member 32 between the arms 37, 38 (FIG. 3) and permits pivotal movement thereof. Included in the assembly 91 (FIGS. 10–13) is a bed 93 secured to the base 23, a clamp 94 (FIG. 2) secured to the lower tubular member 32 and a connecting rod 95 therebetween. An upper end of the connecting rod 95 is pivotally connected to the clamp 94 by a pin 97 and a lower end is secured to a cross shaft 98 by a universal joint 99. The cross shaft 98 is retained within horizontally extending slots 101 in bifurcated appendages 102, 103 projecting upwardly from the bed 93. Attached to the appendage 102 at opposite ends of the slot 101 are nut and bolt assemblies 105. The assemblies 105 retain cam shaped stops 106, 107 having outer surfaces 108, 109 that alternately engage the cross shaft 98 in response to reciprocating motion thereof between first and second positions. By rotationally adjusting the cam shaped stops 106, 107 the length of travel of the cross shaft 98 between the first and second positions within the slots 101 can be adjusted to provide a predetermined resultant translational movement of the strut assembly 22. Translational movement of the assembly 22 is biased in a forward direction by a spring 110 having ends secured by bolt assemblies 111, 112, respectively, to the bed 93 and a slide member 113 supporting the shaft 98. If desired, the orientation of the bed 93 on the base 23 can be reversed to establish a rearward bias for the assembly 22.

OPERATION

Prior to use of the training apparatus 21, the clamp 33 is released to permit movement of the tubular member 31 and therewith the seat 24 into a position comfortable for a trainee 121 (FIGS. 14–17). The tilt of the seat 24 then is adjusted to suit the trainee. In addition, a desired inclination and height for the backrest 71 is obtained by adjustment of the fastener assembly 75 as described above. With the cross shaft 98 engaging the rear cam surface 108, the clamp 94 can be vertically adjusted on the lower tubular member 32 to establish a desired vertical orientation for the strut assembly 22. Similarly, a desired rotational position for the strut assembly 22 relative to the base 23 can be obtained by suitable adjustment of the rotational adjustment mechanism 35. This adjustment establishes the direction of translational motion. The degree of translational movement of the seat 24 made possible by pivotal movement of the strut assembly 22 also can be selected by suitable adjustment of the cam surfaces 108, 109 to establish a predetermined length of travel by the cross shaft 98 within the slots 101. Finally, the precise angular position at which the spinal restraint 26 is released by the release mechanism 28 can be determined by loosening the clamp 33 and utilizing a handle 115 to rotate the upper tubular member 31 and the cam surface 59 thereon into a predetermined angular position with respect to the base 23. In that way, the degree of pivot seat 24 movement required to unlatch the arm 55 and release the spinal restraint 26 can be adjusted.

Figure 14:
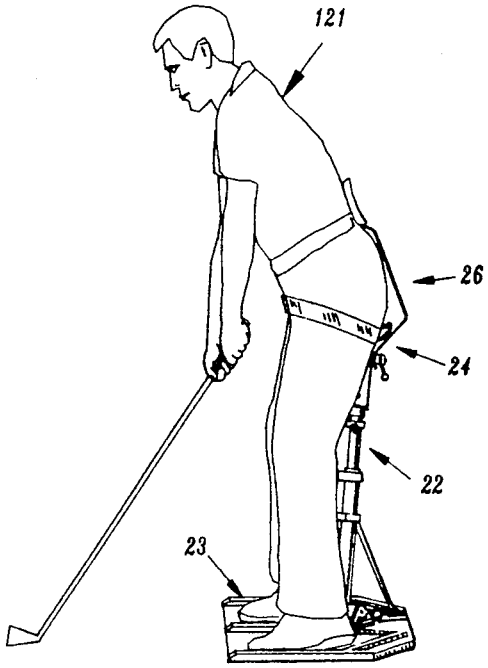
FIGS. 14–17 are schematic views illustrating use of the training apparatus shown in FIGS. 1 and 2 by a golf trainee.
Figure 15:
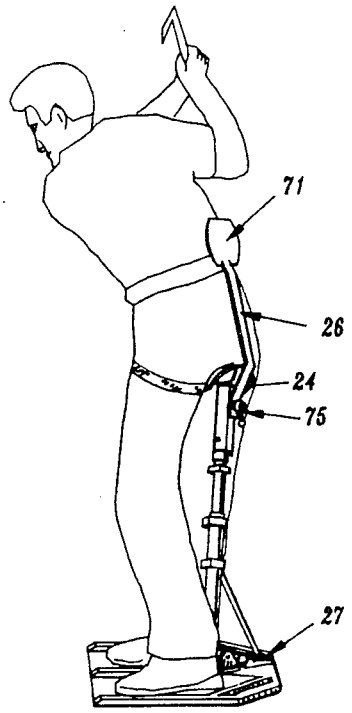
Figure 16:
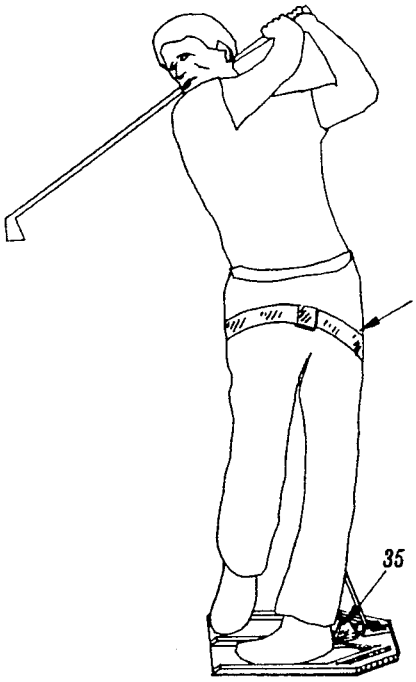
Figure 17:
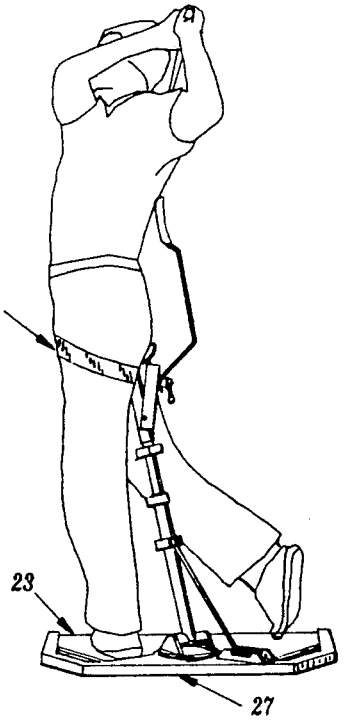

After all manual adjustments have been completed, a golf trainee 121 assumes a position on the base 23 with the seat 24 positioned between his groin regions and lightly touching his buttocks as illustrated in FIG. 14. A belt 117 then can be secured about the trainees waist to retain him in position on the support seat 24 and with his spine resting on the backrest 71. The vertical strut, is then set into the biased position established by the spring 110. During both the backswing depicted in FIG. 15 and the forward swing depicted in FIGS. 16 and 17, the apparatus 21 allows the hips to rotate around a near vertical axis while the slight weight of the body on the seat 24 above this axis keeps the groin area fixed in space. This encourages a rotary motion of the hips in a near-horizontal plane. During the backswing, the spinal restraint 26 prevents lifting of the upper body which rotates in a space about the base of the spine. The proper coiling of the body is aided by the seat 24 which allows the mid section of the body to turn but not sway. During the forward swing shown in FIGS. 16 and 17, the coupling mechanism 27 allows the seat 24 to translate slightly foward while rotating and continuing along with the restraint 26 to properly constrain and guide motion of the hips and lower spine. In addition, at a predetermined point in the forward swing, the release mechanism 28 is activated to release the spinal restraint 26 and allow the upper body to raise into an unstressed, upright position as shown in FIG. 17. This allows the shoulders and arms to turn and swing freely about a supporting body which is moving properly.

When using the apparatus 21, the golfer 121 will be guided through an effective motion of the mid and lower body. The presence of the vertical axis established by the strut 22, the seat 24 and spinal restraint 26 encourages a very smooth rotary motion which prevents lunging, falling back, swaying, and a reverse pivot. On the forward swing, this rotary motion whips the arms past the vertical axis and throws the weight onto the forward foot. However, because the vertical and spinal axes retain the body, there is little change of "spinning out" with the upper body.

Obviously, many modifications and variations of the present invention are possible in light of the above teachings. For example, release mechanisms for the spinal restraint 26 other than the one preferred type disclosed can be employed. It is to be understood, therefore, that the invention can be constructed and practiced otherwise than as specifically described.

What is claimed:

1. Golf swing training apparatus comprising:

elongated strut means having one end adapted for support by a horizontal support surface;

support means retained by a portion of said strut means opposite to said one end, said support means adapted to project between a golfer's legs to engage and control movement of said golfer's groin regions while said golfer is in an upright standing position addressing a golf ball;

rotational coupling means allowing rotation of said support means in response to rotational movement of the golfer's hips; and restraint means supported by said strut means and extending upwardly from said support means, said restraint means adapted to engage and substantially restrain the golfer's spine in a given orientation during said rotation of said support means.

2. An apparatus according to claim 1 including a base means attached to said one end of said strut means and forming the support surface.

3. An apparatus according to claim 1 including translational coupling means adapted during rotation of said support means to allow reciprocating movement thereof in directions transverse to said strut means.

4. An apparatus according to claim 1 including release means for automatically deactivating said restraint means in response to motion of said support means into a predetermined position and to thereby allow movement of the golfer's spine into an orientation different than said given orientation.

5. An apparatus according to claim 4 wherein said release means comprises latch means latching said restraint means in an active position providing said given orientation, and a cam means for engaging said latch means to thereby deactivate said restraint means in response to motion of said support means into said predetermined position.

6. An apparatus according to claim 5 wherein said motion of said support means is rotation and said predetermined position is a predetermined angular position.

7. An apparatus according to claim 6 including bias means biasing said restraint means in said active position.

8. An apparatus according to claim 7 including latch adjustment means for selectively adjusting said predetermined position.

9. An apparatus according to claim 8 including restraint adjustment means for selectively adjusting the height of said restraint means relative to said support means.

10. An apparatus according to claim 9 including a base means attached to said one end of said strut means and forming the support surface.

11. An apparatus according to claim 10 including translational coupling means adapted during rotation of said support means to allow reciprocating movement thereof in directions transverse to said strut means.

12. An apparatus according to claim 11 including rotational adjustment means for selectively adjusting the rotational position of said strut means relative to said base means.

13. An apparatus according to claim 12 including support adjustment means for selectively adjusting the height of said support means above said base means.

14. An apparatus according to claim 13 including inclination adjustment means for selectively adjusting the vertical inclination of said strut means.

15. An apparatus according to claim 14 wherein said translational coupling means permits pivotal movement of said strut means to provide said reciprocating movement, and includes stop means for limiting said reciprocating movement of said support means between predetermined first and second pivotal positions thereof.

16. An apparatus according to claim 15 including stop adjustment means for selectively adjusting the distance between said first and second positions.

17. Golf swing training apparatus comprising:

elongated strut means having one end adapted for support by a horizontal support surface;

support means retained by a portion of said strut means opposite to said one end, said support means adapted to project between a golfer's legs to engage and control movement of said golfer's groin regions while said golfer is in an upright standing position addressing a golf ball;

rotational coupling means allowing rotation of said support means in response to rotational movement of the golfer's hips; and translational coupling means adapted during rotation of said support means to allow reciprocating movement thereof in directions substantially transverse to said strut means.

18. An apparatus according to claim 17 wherein said translational coupling means permits pivotal movement of said strut means to provide said reciprocating movement, and includes stop means for limiting said reciprocating movement of said support means between predetermined first and second pivotal positions thereof.

19. An apparatus according to claim 18 including stop adjustment means for selectively adjusting the distance between said first and second positions.

20. An apparatus according to claim 17 wherein said translational coupling means comprises translational bias means for biasing in a given direction said reciprocating movement of said support means.

21. Golf swing training apparatus comprising:

base means adapted to be positioned on a horizontal surface;

elongated strut means having one end supported by said base means;

support means retained by a portion of said strut means opposite to said one end, said support means adapted to project between a golfer's legs to engage and control movement of said golfer's groin regions while said golfer is in an upright standing position addressing a golf ball; and rotational coupling means allowing rotation of said support means in response to rotational movement of the golfer's hips.

22. An apparatus according to claim 21 including pivotal adjustment means for selectively adjusting the vertical orientation of said strut means relative to said base means.

23. An apparatus according to claim 22 including support adjustment means for selectively adjusting the height of said support means above said base means.

24. An apparatus according to claim 21 including rotational stop mean for engaging said support means to prevent rotational movement thereof in a given direction after a predetermined degree of rotational movement thereof in said given direction.

* * * * *